US006526602B2

(12) United States Patent
Jeon

(10) Patent No.: US 6,526,602 B2
(45) Date of Patent: Mar. 4, 2003

(54) TOILET MOUNTED BIDET

(75) Inventor: Kil Yong Jeon, 5-102 Mido Villa, Kogang-dong, Bucheon-si, Kyunggi-do (KR)

(73) Assignees: Kwan Ho Ahn, Ladera Ranch, CA (US); Kil Yong Jeon, Kyunggi-do (KR); Jai Keun Jo, Kyunggi-do (KR)

( * ) Notice: Subject to any disclaimer, the term of this patent is extended or adjusted under 35 U.S.C. 154(b) by 0 days.

(21) Appl. No.: 09/977,442

(22) Filed: Oct. 15, 2001

(65) Prior Publication Data

US 2002/0042946 A1 Apr. 18, 2002

(30) Foreign Application Priority Data

Oct. 16, 2000 (KR) ..... 2000-60779

(51) Int. Cl.[7] ..... E03D 9/08
(52) U.S. Cl. ..... 4/420.4; 239/418; 239/553.5
(58) Field of Search ..... 4/420.4, 447, 448; 239/418, 553, 553.5

(56) References Cited

U.S. PATENT DOCUMENTS 2,655,988 A * 10/1953 Marra ..... 239/418 X
3,164,846 A * 1/1965 Foster ..... 4/448
4,550,454 A * 11/1985 Yui ..... 4/420.4
4,696,673 A * 9/1987 Ledin-Bonevik ..... 4/420.4 X
5,987,660 A * 11/1999 Wang ..... 4/420.4
6,249,921 B1 * 6/2001 Daniel et al. ..... 4/420.4

* cited by examiner

*Primary Examiner*—Charles E. Phillips
(74) *Attorney, Agent, or Firm*—Lee & Hong; Jonathan Y. Kang

(57) ABSTRACT

Disclosed herein is a toilet mounted bidet. The toilet mounted bidet includes a mounting plate attached to a toilet bowl. The toilet mounted bidet further includes an ejection nozzle that is comprised of a nozzle body and a nozzle cap joined together. The nozzle body is provided through the center portion thereof with a center ejection hole and along the outer surface thereof with a plurality of circumferential ejection grooves to allow washing water ejected through the center ejection hole to be integrated with the circumferential ejection holes. An arm is hingedly attached to the mounting plate and provided at its one end with the ejection nozzle. A water supply pipe supplies washing water to the ejection nozzle. Water pressure adjusting means optionally adjusts the pressure of washing water by adjusting the opening ratio of the water supply pipe.

3 Claims, 7 Drawing Sheets

TOILET MOUNTED BIDET

BACKGROUND OF THE INVENTION

1. Field of the Invention

The present invention relates generally to bidets, and more particularly to a toilet mounted bidet, which is capable of simply adjusting the pressure of washing water used therefor, using purified water as the washing water, and being used for medical purposes, such as the administration of the enema.

2. Description of the Prior Art

In general, a conventional toilet mounted bidet is adapted to eject water using an ejection nozzle attached to the seat of the toilet such that a user can clean his anus without using toilet paper. The conventional bidet is comprised of a base plate attached to the seat of a toilet, an ejection nozzle situated under the base plate, and a washing water supply conduit provided on one side of the seat and connected to a water pipe to supply water to the ejection nozzle. A pair of brackets formed on one side of the base plate are attached to the seat by means of bolts.

In the meantime, in the conventional toilet mounted bidet, its ejection nozzle is fixedly attached to its base plate, so the ejection nozzle should take a fixed position while the bidet is mounted on a toilet. Accordingly, there arises a problem that a user cannot adjust the ejecting direction of washing water to correspond to the physique and habit of a user.

Water contaminated by contaminants in water or rust on a water pipe may be supplied to a bidet, so there is increased demand for using purified water in the bidet.

The bidet is desired to be used for medical purposes, such as the administration of the enema, as well as the washing of the anus.

In addition, in the conventional bidet, the pressure of washing water is adjusted by pushing a button. Accordingly, the pressure of washing water can be adjusted at discontinuous stages, such as a high pressure stage, an intermediate pressure stage and a lower pressure stage, so an appropriate water pressure cannot be provided to persons who are sensitive to water pressure. Furthermore, patients having the reduced dexterity of their fingers cannot push the button, so water pressure cannot be appropriately adjusted by them.

SUMMARY OF THE INVENTION

Accordingly, the present invention has been made keeping in mind the above problems occurring in the prior art, and an object of the present invention is to provide a toilet mounted bidet, which is capable of adjusting the position of its ejection nozzle according to the physique and individual habit of a user, and is hygienic to the user because of the supply of purified water.

Another object of the present invention is to provide a toilet mounted bidet, which is provided with water pressure adjusting means to allow the pressure of washing water to be simply and continuously adjusted to an appropriate pressure, and is capable of forming a plurality of bubbles in washing water by means of an ejection nozzle, thereby allowing the toilet mounted bidet to be used for medical purposes, such as the administration of the enema.

In order to accomplish the above object, the present invention provides a toilet mounted bidet, comprising a mounting plate attached to a toilet bowl; an ejection nozzle comprised of a nozzle body and a nozzle cap screwed over the nozzle body, the nozzle body being provided through the center portion thereof with a center ejection hole and along the outer surface thereof with a plurality of circumferential ejection grooves to allow washing water ejected through the center ejection hole to be integrated with the circumferential ejection holes; an arm hingedly attached to the mounting plate and provided at its one end with the ejection nozzle; a water supply pipe for supplying washing water to the ejection nozzle; and water pressure adjusting means for optionally adjusting the pressure of washing water by adjusting the opening ratio of the water supply pipe.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
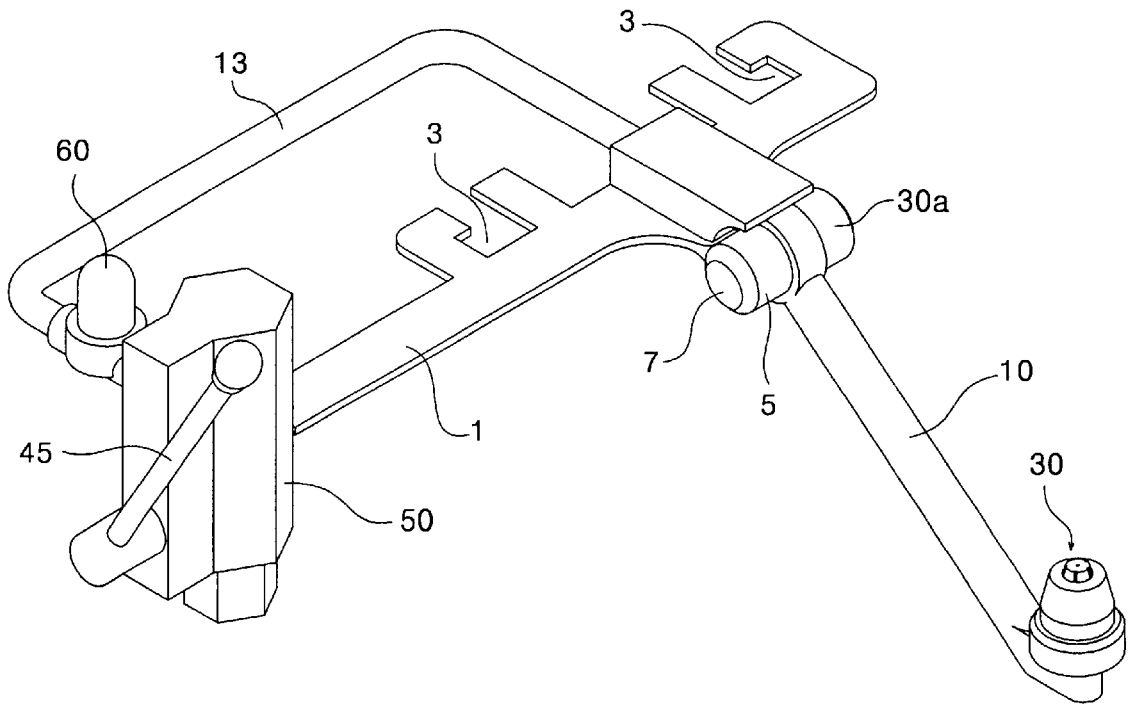
FIG. 1 is a perspective view showing a toilet mounted bidet in accordance with the present invention.

Reference now should be made to the drawings, in which the same reference numerals are used throughout the different drawings to designate the same or similar components.

FIG. 1 is a perspective view showing a toilet mounted bidet in accordance with the present invention. The bidet of the present invention includes a mounting plate 1. The mounting plate 1 is provided with a cutout 3 that allows the mounting plate 1 to be easily attached to a toilet bowl (not shown). A water pressure adjusting valve 50 is mounted on one end of the mounting plate 1. An arm 10 is forwardly extended from the mounting plate 1 while being hingedly attached thereto. An ejection nozzle 30 is mounted on the front end of the arm 10.

In the meantime, a water purifier 60 is positioned in the middle of a water supply pipe 13 that connects the ejection nozzle 30 and the water pressure adjusting valve 50 to supply purified water to a user.

Figure 2:
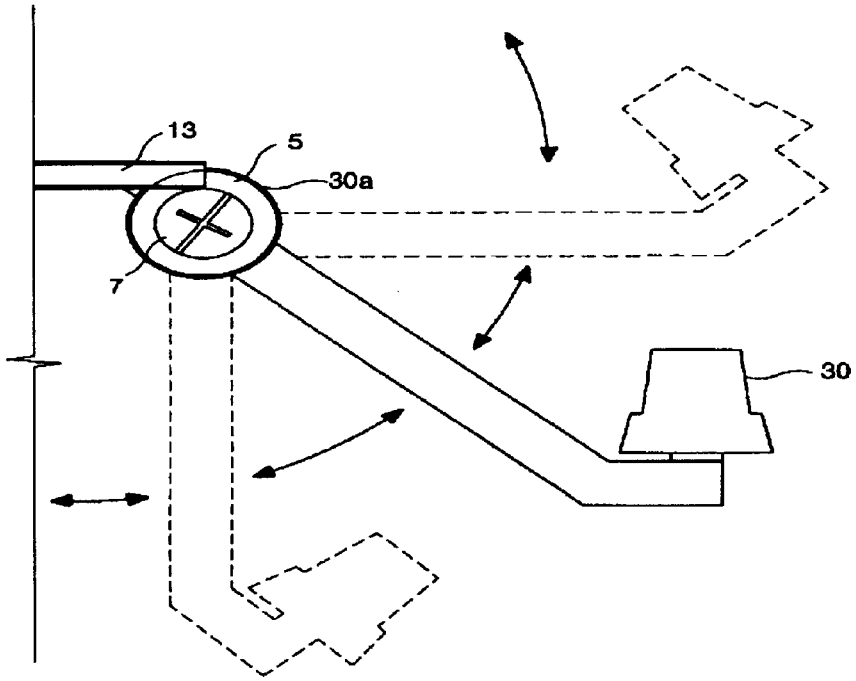
FIG. 2 is a view showing the operation of adjusting the position of the ejection nozzle of the bidet.

FIG. 2 is a side view showing the operation of adjusting the position of the ejection nozzle of the toilet. The ejection nozzle 30 can be vertically rotated around a boss 30*a* according to the physique and position of a user.

The sleeve 5 of the mounting plate 1 is tightly fitted around the boss 30*a*, so the ejection nozzle 30 can be rotated while being watertight and the ejection nozzle 30 can be secured in any adjusted angular position.

As shown in accompanying drawings, washing water discharged through the water supply pipe 13 flows through the ring-shaped interior space of the boss 39*a* situated around the shaft 7. Accordingly, even though the ejection nozzle 30 is rotated at any optional angle, a constant amount of washing water can flow through the interior of the boss 39*a* without hindrance.

Figure 3A:
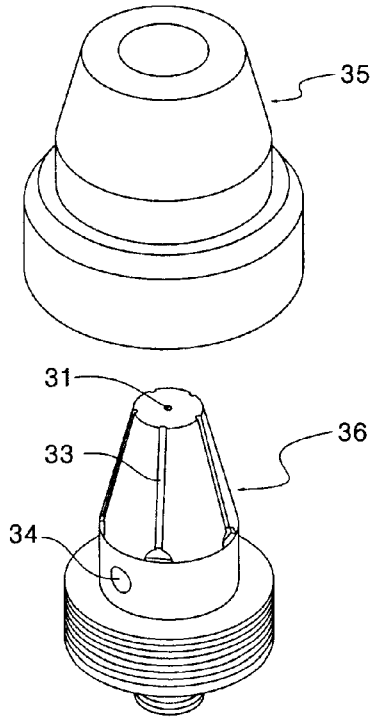
FIG. 3*a* is an exploded perspective view showing the ejection nozzle of the bidet.

FIG. 3*a* is an exploded perspective view showing the ejection nozzle 30 of the bidet of the present invention. A center ejection hole 31 is formed across the vertical center of the nozzle body 36 of the ejection nozzle 30. A plurality of circumferential ejection grooves 33 are formed along the outer surface of the nozzle body 36. A discharge hole 34 is formed across the lower portion of the nozzle body 36.

A nozzle cap 35 is interlocked with the nozzle body 36. An interior thread portion is formed on the lower portion of the inner surface of the nozzle cap 35. The upper portion of the nozzle cap 35 is slanted at the same angle as the upper portion of the nozzle body 36, so the upper portion of the nozzle body 36 is brought into tight contact with the upper portion of the nozzle cap 35.

In brief, the center ejection groove 31 is surrounded by a plurality of circumferential ejection grooves 33 that are arranged in a circle.

Figure 3B:
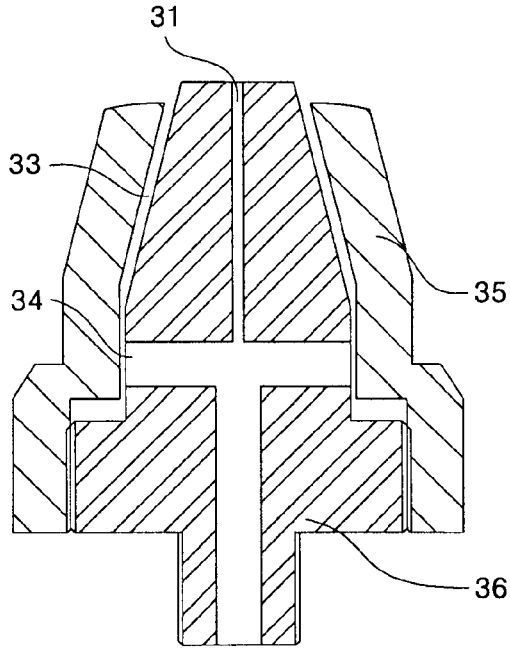
FIG. 3*b* is a cross section showing the ejection nozzle of the bidet.

FIG. 3*b* is a cross section showing the ejection nozzle of the bidet of the present invention. Washing water supplied through the water pipe reaches the center portion of the nozzle body 36 and, subsequently, is forced into both the center ejection hole 31 and the discharge hole 34. Thereafter, the washing water forced into the discharge hole 34 is ejected through the circumferential ejection grooves 33, thus being integrated with washing water ejected through the center ejection hole 31.

In the meantime, the diameter of the inflow conduit of the nozzle body 36 is preferably about 5 mm, the diameter of the center ejection hole 31 is preferably about 1.2 mm, the tilt angle of the outer surface of the nozzle body 36 where the circumferential ejection grooves 33 are formed are about 45°, the diameter of each circumferential ejection groove 33 is preferably about 0.7 mm, and the number of the circumferential grooves 33 is preferably five or six. However, these are illustrated by example, but are not intended to limit the present invention.

Figure 4:
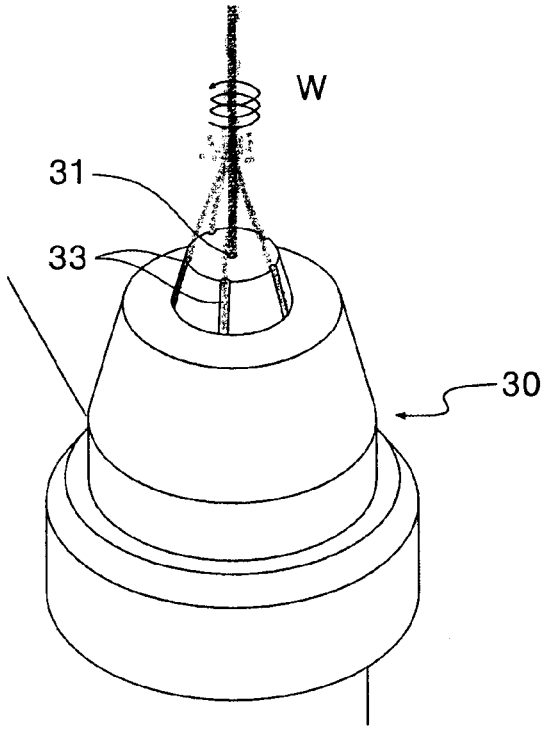
FIG. 4 is a perspective view showing washing water being ejected from the ejection nozzle.

FIG. 4 is a view showing washing water being ejected from the ejection nozzle 30. When washing water is supplied to the ejection nozzle 30 through the water supply pipe 13, a plurality of water streams are ejected along the circumferential ejection grooves 33 formed on the outer surface of the nozzle body 36 in a circle, and are brought into contact with a water stream ejected through the center ejection hole 31. That is, washing water ejected through the circumferential ejection grooves 31 is integrated with washing water upwardly ejected through the center ejection hole 31 at a position upwardly spaced apart from the nozzle body 36 by about 3 cm. At this time, the integrated washing water is rotated while forming bubbles. The rotated washing water "W" can forcibly wash the desired portion of a user at a high speed. Furthermore, when the pressure of washing water "W" is increased, the washing water "W" is injected into the rectum of a user, thereby discharging excrements and gas from the rectum. Meanwhile, the bubbles formed by the collision of water streams soften the stream of the integrated washing water, so even when the pressure of the washing water is high, a user does not feel any pain or discomfort, and water drops are scattered away. Additionally, the bubbles serve to reduce the chill of cold water, so a user can use the bidet of the present invention without feeling a chill, even in winter.

Figure 5:
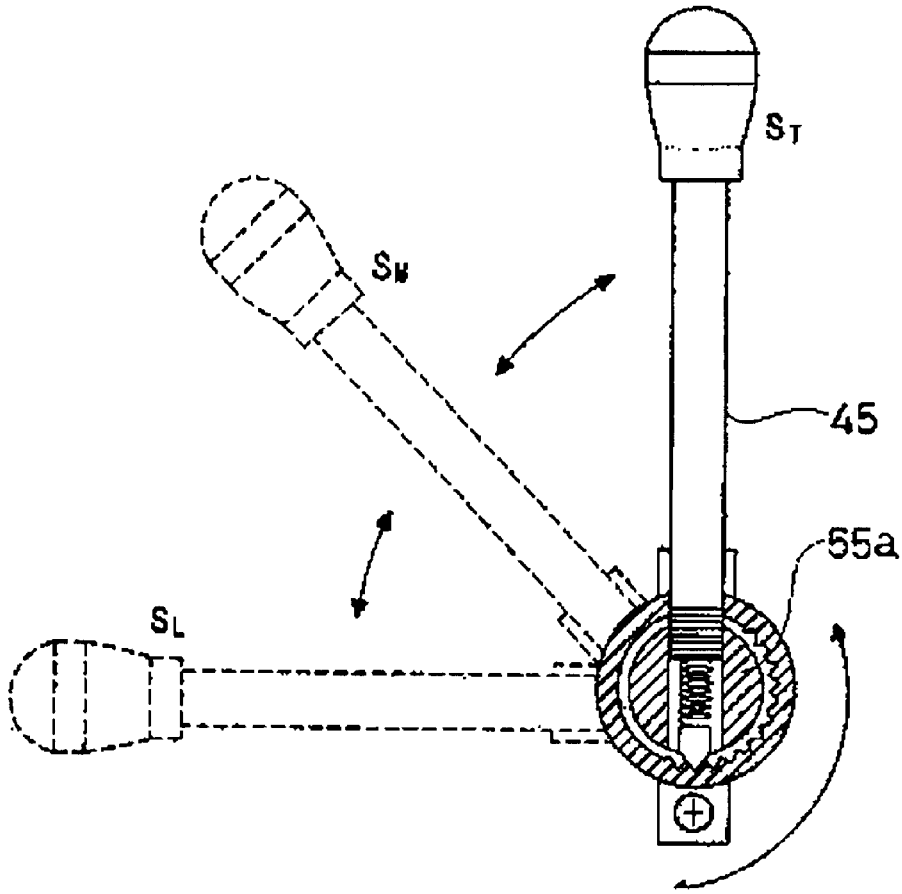
FIG. 5 is a view showing the water pressure adjusting lever of the bidet.

FIG. 5 is a view of a staged water pressure adjusting lever. The staged water pressure adjusting lever has a simple mechanical structure. The staged water pressure adjusting lever is adapted to be simply manipulated by a user so as to adjust the pressure of washing water from a high pressure to a low pressure. The pressure of the water pressure can be adjusted continuously. The water pressure adjusting lever adjusts the pressure of washing water by increasing and decreasing the opening ratio of the water supply pipe according to the rotation of the water pressure adjusting lever. By the water pressure adjusting lever, the old, the feeble and the handicapped can conveniently use the bidet of the present invention. As the water pressure adjusting lever is rotated from a position $S_L$ to a position $S_T$, the pressure of washing water is increased or decreased. At a position $S_M$, the pressure of washing water is intermediate.

Figure 6:
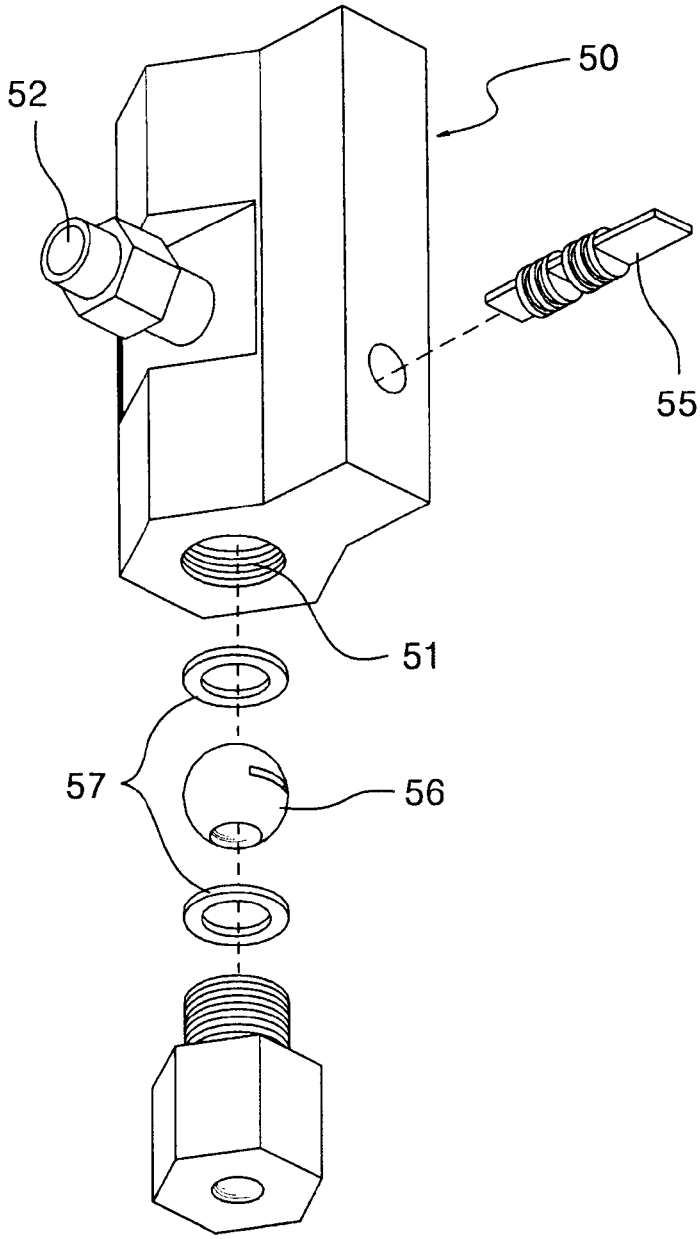
FIG. 6 is an exploded perspective view showing the water pressure adjusting valve of the bidet.

FIG. 6 is an exploded perspective view showing the water pressure adjusting valve of the bidet of the present invention. Washing water flows into the water pressure adjusting valve through the entrance of the water pressure adjusting valve, is adjusted in pressure in the valve body of the water pressure adjusting valve 50, and is discharged through the exit 52 of the water pressure adjusting valve. The washing water is forced into the ejection nozzle 30. One end of the water pressure adjusting knob 55 of the water pressure adjusting valve is inserted into a rotating shaft (55*a* in FIG. 5) interlocked with the lower end of the water pressure adjusting lever (45 in FIG. 5), and the other end of the water pressure adjusting knob 55 of the water pressure adjusting valve is inserted into a valve ball 56 positioned in the valve body of the water pressure adjusting valve 50. The valve ball 56 has a cylindrical center hole, and is situated in a washing water passage formed through the water pressure adjusting valve. When the water pressure adjusting lever 45 is rotated as shown in FIG. 5, the rotating shaft 55*a* connected to the lower end of the water pressure adjusting lever 45 is rotated together with the water pressure adjusting knob 55, thereby rotating the valve ball 56. As the valve ball 56 is rotated, the opening ratio of the washing water passage of the valve body of the water pressure adjusting valve 50 is varied by the action of the cylindrical hole formed in the valve ball 56, so the amount of discharged washing water is varied, resulting in the variation of the pressure of the washing water.

Meanwhile, two O-rings are positioned under and over the valve ball 56, respectively, so as to allow the valve ball 56 to be smoothly rotated.

The bidet of the present invention is provided with a water purifier. The water purifier is similar to a general water purifier filter device, and can be situated in one side of the water supply pipe or the connection portion between the water supply pipe and a coupling.

When washing water contaminated by contaminants in water and the rust on a water pipe is supplied to the bidet, the washing water may injure the health of a user, and further cannot be used for medical purposes. Accordingly, washing water used for the bidet of the present invention is desirably purified water.

Figure 7:
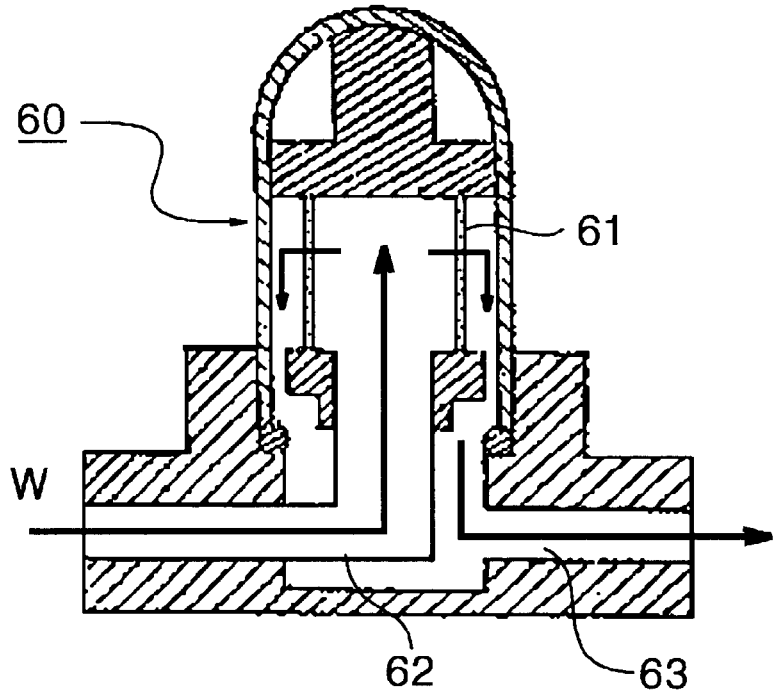
FIG. 7 is a cross section showing the purifying operation of the purifier of the bidet.

FIG. 7 is a cross section showing the purifying operation of the purifier of the bidet of the present invention. An inlet passage 62 and an outlet passage 63 are formed in the water purifier 60, and are separated from each other. A purifying filter element 61 is situated in the upper end of the inlet passage 62. As a result, washing water having flowed through the inlet passage 62 always passes through the purifying filter element 61 into the outlet passage 63, so the washing water is always purified.

Figure 8:
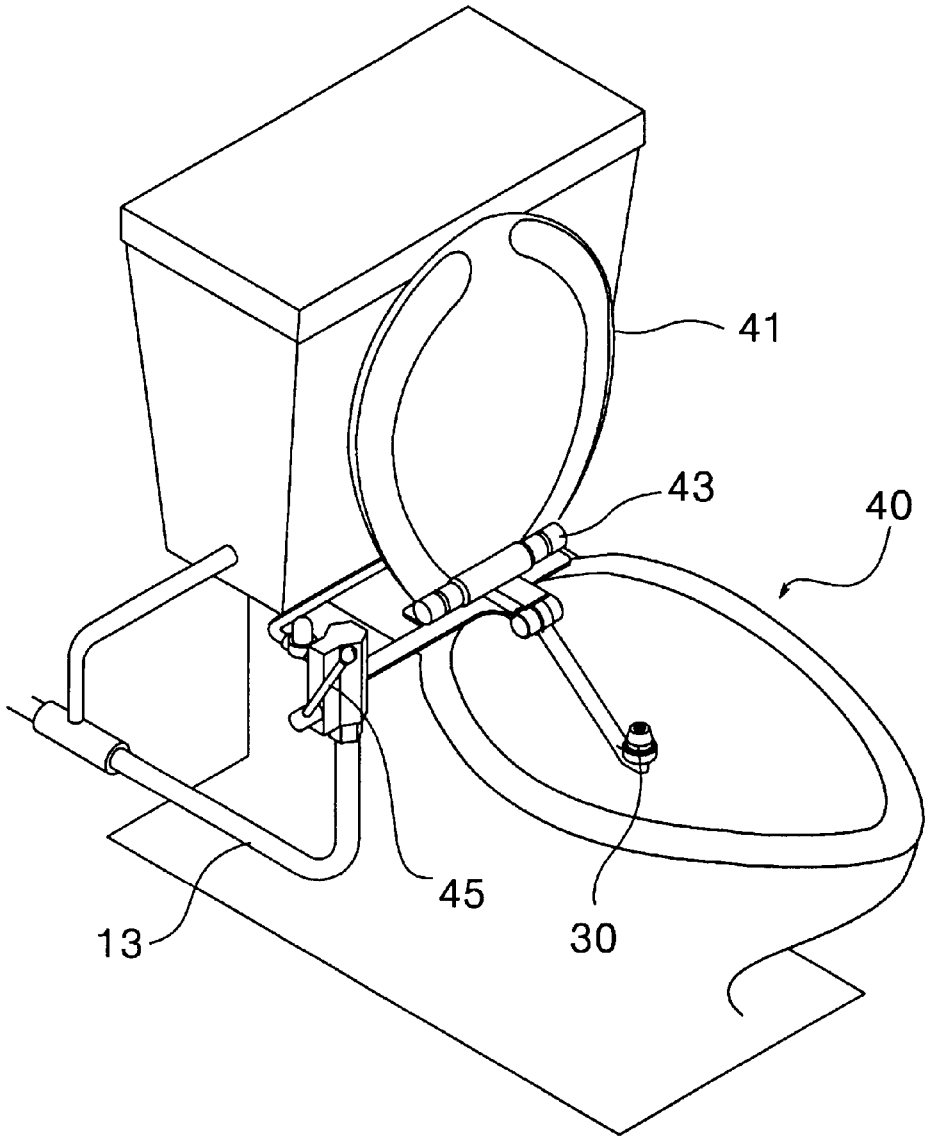
FIG. 8 is a view showing the use of the bidet.

FIG. 8 is a view showing the use of the bidet of the present invention. As shown in the drawing, the bidet of the present invention is attached to a toilet bowl 40 by bolts 43 that are used to attach a toilet seat 41 to the toilet bowl 40.

The water supply pipe 13 is extended to the water pressure adjusting valve 50 connected to a water supply line to adjust the pressure of washing water. Accordingly, the bidet of the present invention can eject washing water under an appropriate water pressure by manipulating the water pressure adjusting lever 45.

The ejection nozzle 30 can be adjusted in its vertical position to correspond to the physique and purpose of a user.

The bidet of the present invention can be fabricated in metal or synthetic resin. The materials of the bidet are not limited to these, but may be any material that is suitable for the purpose of the present invention.

As described above, the present invention provides a toilet mounted bidet, which is capable of adjusting the position of its ejection nozzle according to the physique of a user and the purpose and habit of use of the user, and utilizing purified water.

Additionally, the bidet of the present invention employs a staged water pressure adjusting lever, so the pressure of washing water is conveniently adjusted and the bidet can be utilized for medical purposes.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A toilet mounted bidet, comprising:

a mounting plate attached to a toilet bowl;

an ejection nozzle comprised of a nozzle body and a nozzle cap screwed over the nozzle body, said nozzle body being provided through the center portion thereof with a center ejection hole and along the (water ejected from the) outer surface thereof with a plurality of circumferential ejection grooves to allow washing water ejected through the center ejection hole to be integrated with the circumferential ejection holes;

an arm hingedly attached to the mounting plate and provided at its one end with the ejection nozzle;

a water supply pipe for supplying washing water to the ejection nozzle; and water pressure adjusting means for optionally adjusting the pressure of washing water by adjusting the opening ratio of the water supply pipe.

2. The toilet mounted bidet according to claim 1, wherein said water pressure adjusting means comprises a valve ball provided with a through hole, a water pressure adjusting knob interlocked with the valve ball, and a water pressure adjusting lever connected to the water pressure adjusting knob 55 to rotate the valve ball.

3. The toilet mounted bidet according to claim 1, wherein said water supply pipe is provided with an inlet water passage, an outlet water passage and a water purifier, said inlet and outlet water passages being partitioned from each other, said water purifier being positioned between the inlet and outlet water passages.

* * * * *